US008494406B2

(12) United States Patent
Nakasone

(10) Patent No.: US 8,494,406 B2
(45) Date of Patent: Jul. 23, 2013

(54) DEVELOPER STORAGE CONTAINER, DEVELOPING DEVICE AND IMAGE FORMING APPARATUS

(75) Inventor: Yasushi Nakasone, Toyko (JP)

(73) Assignee: Oki Data Corporation, Tokyo (JP)

( * ) Notice: Subject to any disclaimer, the term of this patent is extended or adjusted under 35 U.S.C. 154(b) by 339 days.

(21) Appl. No.: 12/923,211

(22) Filed: Sep. 9, 2010

(65) Prior Publication Data

US 2011/0064480 A1 Mar. 17, 2011

(30) Foreign Application Priority Data

Sep. 11, 2009 (JP) ..... 2009-210014

(51) Int. Cl.
*G03G 15/08* (2006.01)

(52) U.S. Cl.
USPC ..... 399/106; 399/119

(58) Field of Classification Search
USPC ..... 399/102–106, 119, 262
See application file for complete search history.

(56) References Cited

U.S. PATENT DOCUMENTS

| | | | | |
|---|---|---|---|---|
| 5,345,297 | A | 9/1994 | Katakabe et al. | |
| 6,018,638 | A * | 1/2000 | Li | 399/106 |
| 6,484,000 | B1 | 11/2002 | Ogawa et al. | |
| 7,519,311 | B2 * | 4/2009 | Murakami et al. | 399/111 |
| 7,729,645 | B2 * | 6/2010 | Noguchi | 399/262 |
| 7,780,040 | B2 * | 8/2010 | Wegman | 222/162 |
| 7,983,590 | B2 * | 7/2011 | Sakuma | 399/102 |
| 2005/0265752 | A1 | 12/2005 | Nagahama et al. | |
| 2006/0201971 | A1 * | 9/2006 | Wegman | 222/162 |
| 2009/0087215 | A1 * | 4/2009 | Sakuma | 399/105 |
| 2009/0087216 | A1 * | 4/2009 | Sakuma | 399/106 |
| 2009/0116877 | A1 * | 5/2009 | Sakuma | 399/262 |
| 2010/0272465 | A1 * | 10/2010 | Yamazaki | 399/106 |

FOREIGN PATENT DOCUMENTS

| | | |
|---|---|---|
| JP | 6-95505 | 4/1994 |
| JP | 11-125963 | 5/1999 |
| JP | 2002-235331 | 8/2002 |
| JP | 2002-372843 | 12/2002 |
| JP | 2003-42295 | 2/2003 |
| JP | 2007-17684 | 1/2007 |
| JP | 2007-093737 A | 4/2007 |
| JP | 2007-286485 | 11/2007 |
| JP | 2009-48068 | 3/2009 |

* cited by examiner

*Primary Examiner* — G. M. Ali Hyder
(74) *Attorney, Agent, or Firm* — Rabin & Berdo, P.C.

(57) ABSTRACT

A developer storage container includes a storage portion for storing a developer therein. The storage portion has an opening through which the developer is ejected. A convex portion is provided around the opening of the storage portion. The convex portion protrudes outward from the storage portion.

10 Claims, 13 Drawing Sheets

DEVELOPER STORAGE CONTAINER, DEVELOPING DEVICE AND IMAGE FORMING APPARATUS

BACKGROUND OF THE INVENTION

The present invention relates to a developer storage container, a developing device and an image forming apparatus.

In a conventional image forming apparatus, a developer storage container is detachably mounted to a developing unit, and supplies a developer (i.e., a toner) to the developing unit.

A sealing member such as a urethane sponge is adhered to a portion around a developer receiving opening formed on the developing unit. In a state where the developer storage container is mounted to the developing unit, the sealing member seals between the developer storage container and the developing unit. The sealing member prevents leakage of the developer through between the developer storing container and the developing unit (see, for example, Japanese Laid-Open Patent Publication No. 2007-93737).

Recently, there is a demand for enhancement in sealing performance.

SUMMARY OF THE INVENTION

The present invention is intended to provide a developer storage container, a developing device, and an image forming apparatus capable of effectively prevent leakage of a developer.

The present invention provides a developer storage container including a storage portion for storing a developer therein. The storage portion has an opening through which the developer is ejected. A convex portion is provided around the opening of the storage portion. The convex portion protrudes outward from the storage portion.

The present invention also provides a developing device including a first storage container for storing a developer therein. The first storage container has a first opening through which the developer is ejected. A convex portion is provided around the first opening of the first storage container. The convex portion protrudes outward from the first storage container. A second opening is provided at a position corresponding to the first opening. A sealing member is provided around the second opening.

With such a configuration, since the sealing member and the convex portion are provided, leakage of the developer is effectively prevented.

The present invention also provides an image forming apparatus including the above described developer storage container.

The present invention also provides an image forming apparatus including the above described developing device.

Further scope of applicability of the present invention will become apparent from the detailed description given hereinafter. However, it should be understood that the detailed description and specific embodiments, while indicating preferred embodiments of the invention, are given by way of illustration'only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The present invention is not limited to the embodiment described below, and modifications and improvements may be made to the invention without departing from the spirit and scope of the invention.

First Embodiment

Figure 1:
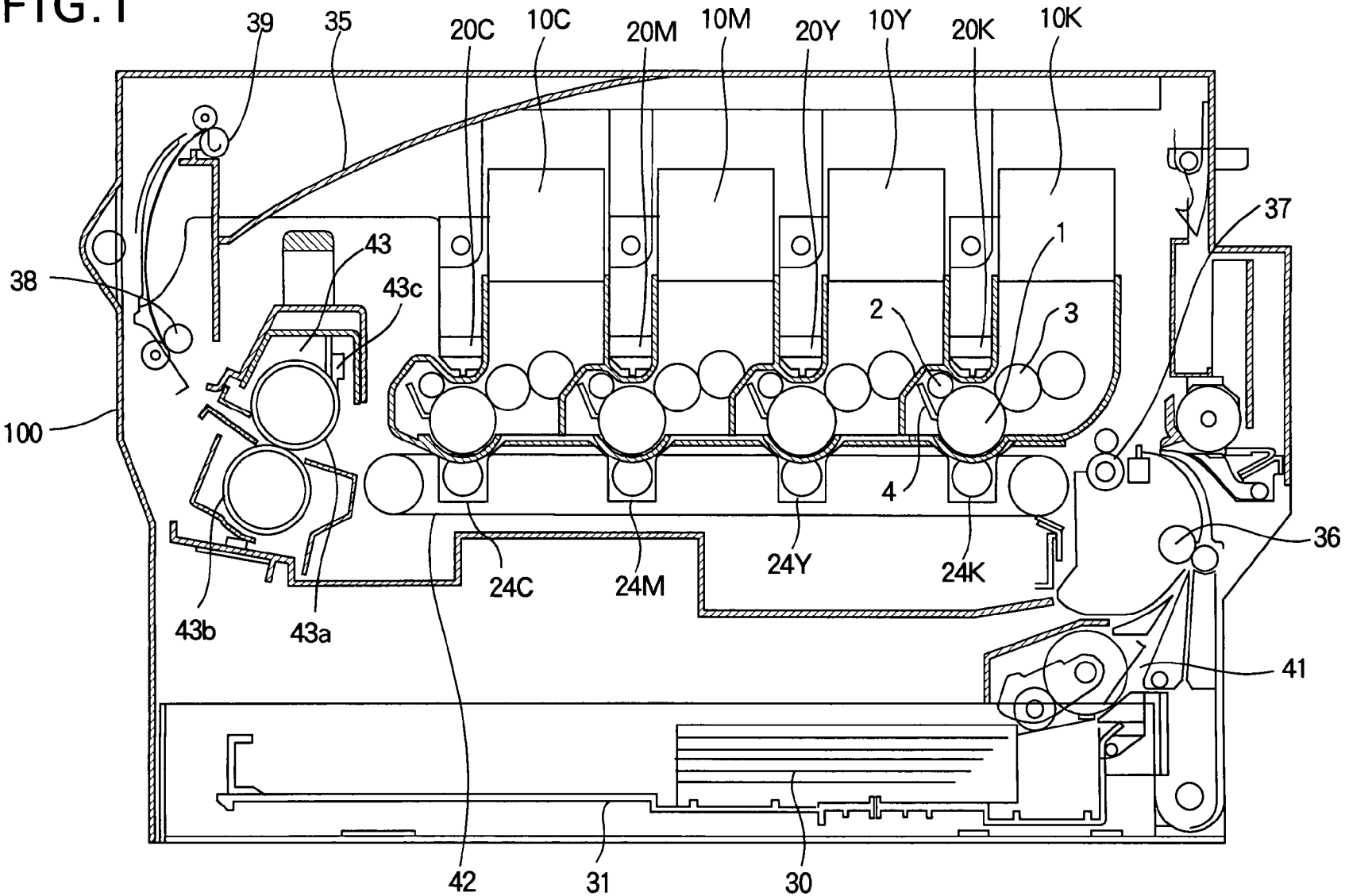
FIG. 1 is a sectional view schematically showing an image forming apparatus according to the first embodiment of the present invention.

FIG. 1 is a sectional view schematically showing an image forming apparatus 100 according to the first embodiment of the present invention.

The image forming apparatus 100 is configured as, for example, a color electrophotographic printer. The image forming apparatus 100 includes a recording medium storage case 31 for storing recording media 30 such as recording sheets. The image forming apparatus 100 further includes exposure heads 20K, 20Y, 20M and 20C (collectively referred to as the exposure heads 20) for forming latent images on photosensitive drums 1 described later. The image forming apparatus 100 further includes developing devices 10K, 10Y, 10M and 10C (collectively referred to as the developing devices 10) for developing the latent images formed by the exposure devices 20 using toners (developers) to thereby form the toner images. The developing devices 10K, 10Y, 10M and 10C are also referred to as process units or image forming units. The image forming apparatus 100 further includes transfer units 24K, 24Y, 24M and 24C (collectively referred to as the transfer units 24) for transferring the toner images from the photosensitive drums 1 to the recording medium 30. The image forming apparatus 100 further includes a fixing unit 43 for fixing the toner image to the recording medium 30. The image forming apparatus 100 further includes feeding units 36 and 36 for feeding the recording medium 30, and ejection units 38 and 39 for ejecting the recording medium to a stacker 35 provided outside the image forming apparatus 100.

The recording medium storage case 31 is configured to store a stack of the recording media 30, and is detachably mounted to a lower part of the image forming apparatus 100. A pickup roller 41 (as a separation mechanism) is configured to pick up the uppermost recording medium 30 and feeds the recording medium 30 to a recording medium feeding path formed on a lower frame of the image forming apparatus 100. The feeding units 36 and are constituted by a plurality of pairs of rollers disposed along the recording medium feeding path, and feed the recording medium 30 to the developing devices 10 while correcting the skew of the recording medium 30.

Each of the exposure heads 20K, 20Y, 20M and 20C is constituted by, for example, an LED (Light Emitting Diode) head including light emitting elements such as LEDs and a lens array. The exposure heads 20K, 20Y, 20M and 20C emit lights to expose the surfaces of the photosensitive drums 1 based on inputted print data. Electric potentials at the exposed parts on the surfaces of the photosensitive drums 1 attenuate, and latent images are formed.

The developing devices 10K, 10Y, 10M and 10C supply toners (developers) to the surfaces of the photosensitive drums 1 so as to develop the latent images formed by the exposure heads 20. In this embodiment, the image forming apparatus 100 includes four developing devices 10K, 10Y, 10M and 100 corresponding to black, yellow, magenta and cyan. The developing devices 10K, 10Y, 10M and 100 are linearly arranged along the recording medium feeding path, and are detachably mounted to the lower frame of the image forming apparatus 100. Detailed descriptions of the developing devices 10K, 10Y, 10M and 10C will be made later.

The transfer units 24K, 24Y, 24M and 24C have transfer rollers that transfer respective toner images from the photosensitive drums 1 to the recording medium 30 which is electrostatically held and fed by a transfer belt (i.e., an endless belt) 42. The transfer rollers are pressed against the photosensitive drums 1 of the respective developing devices 10, and are applied with bias voltages by power sources (not shown) to thereby transfer the toner images from the photosensitive drums 1 to the recording medium 30.

The fixing unit 43 is provided on the downstream side of the developing devices 10 along the recording medium feeding path. The fixing unit 43 is configured to fix the toner image (having been transferred to the recording medium 30 by the transfer units 24) to the recording medium 30. The fixing unit 43 includes a heat roller 43*a*, a pressure roller 43*b*, a heater (not shown) and a thermistor 43*c*. The heat roller 43*a* includes a cylindrical metal core formed of aluminum or the like, a thermally-resistant resilient layer formed of silicone rubber or the like covering the metal core, and a PFA (Tetra fluoro ethylene-perfluoro alkylvinyl ether copolymer) tube covering the resilient layer. The heater such as a halogen lamp is disposed inside the metal core. The pressure roller 43*b* is a metal core of aluminum or the like, a thermally-resistant resilient layer covering the metal core, and a PFA tube covering the resilient layer. The heat roller 43*a* and the pressure roller 43*b* are provided so as to form a nip portion therebetween. The thermistor 43*c* is provided in the vicinity of the heat roller 43*a*, and detects a surface temperature of the heat roller 43*a*. Temperature information detected by the thermistor 43*c* is sent to a not shown temperature control unit. The temperature control unit performs ON/OFF control of the heater so as to maintain the surface temperature of the heat roller 43*a* at a predetermined temperature.

The ejection units 38 and 39 are constituted by a plurality of pairs of rollers, and eject the recording medium 30 (to which the toner image is fixed by the fixing unit 43) to the stacker 35.

In addition to the above described components, the image forming apparatus 100 includes a display unit having, for example, an LCD (Liquid Crystal Display) for displaying a condition of the image forming apparatus 100, and an operation unit having, for example, a touch panel with which a user can input instructions.

The above described image forming apparatus 100 forms, transfers and fixes the toner images to the recording medium 30, i.e., outputs images according to the inputted print data.

Next, the developing devices 10K, 10Y, 10M and 10C will be described.

The developing devices 10K, 10Y, 10M and 10C form toner images of the respective colors, i.e., black, yellow, magenta and cyan. The developing devices 10K, 10Y, 10M and 10C have common structures except the toners. Hereinafter, the common structure of the developing device 10 will be described with reference to FIGS. 2 through 7.

Figure 2:
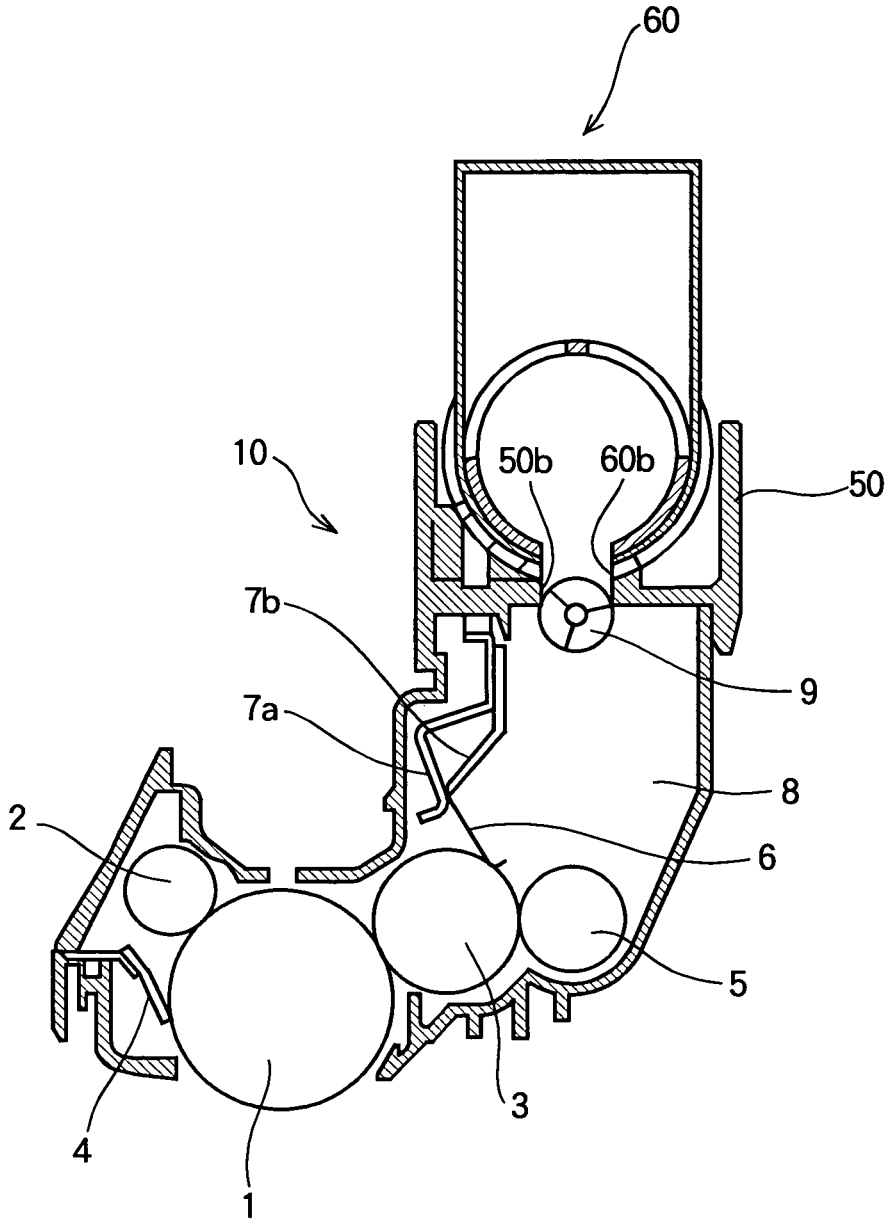
FIG. 2 is a sectional view schematically showing a developing device according to the first embodiment of the present invention.

FIG. 2 is a sectional view schematically showing the structure of the developing device 10.

The developing device 10 includes the photosensitive drum 1, a charging roller 2 that uniformly charges the surface of the photosensitive drum 1, a developing roller that electrically charges the toner and supplies the toner to the photosensitive drum 1, and a cleaning blade 4 that scrapes off the residual toner from the surface of the photosensitive drum 1. The developing device 10 further includes a supplying roller 5 that supplies the toner to the developing roller 3, a developing blade 6 that regulates a thickness of the toner layer on the surface of the developing roller 3, a developer storage portion 8 (i.e., a second storage container) that stores the toner, and a developer storage container 60 (i.e., a storage portion or a first storage container). Further, an agitator 9 is provided for supplying the toner from the developer storage container 60 to the developer storage portion 8. Furthermore, a developer storage container mounting portion 50 is provided on the developer storage portion 8, to which the developer storage container 60 is mounted.

The photosensitive drum (i.e., a latent image bearing body) 1 includes an electrically conductive supporting body and a photoconductive layer. To be more specific, the photosensitive drum 1 is composed of an organic photosensitive body including a metal pipe of aluminum or the like (i.e., the electrically conductive supporting body) with an electron generation layer and an electron transport layer (i.e., the photoconductive layer) laminated thereon. The surface of the photosensitive drum 1 is uniformly charged by the charging roller 2, and is exposed with light emitted by the exposure head 20 so that a latent image is formed thereon.

The charging roller (i.e., a charging unit) 2 includes a metal shaft covered with a semiconductive rubber layer such as epichlorohydrin rubber. The charging roller 2 is provided so as to contact the surface of the photosensitive drum 1, and rotates following the rotation of the photosensitive drum 1. The charging roller 2 is connected to a charging roller power source (not shown), and is applied with a bias voltage having the same polarity as the toner. With such a bias voltage, the charging roller 2 uniformly charges the surface of the photosensitive drum 1.

The developing roller (i.e., a developer bearing body) 3 includes a metal shaft covered with a semiconductive urethane rubber layer. The developing roller 3 is pressed against the photosensitive drum 1 by a predetermined amount. The developing roller 3 supplies the toner to the latent image on the photosensitive drum 1 to reversely develop the latent image. The developing roller 3 is connected to a developing roller power source, and is applied with a bias voltage having the same polarity as or the opposite polarity to the toner. With such a bias voltage, the developing roller 3 electrically charges the toner, and causes the toner to adhere to the latent image on the surface of the photosensitive drum 1.

The cleaning blade (i.e., a cleaning unit) 4 is composed of a urethane rubber, and has an edge portion contacting the surface of the photosensitive drum 1. The cleaning blade 4 scrapes off the residual toner remaining on the surface of the photosensitive drum 1, so as to clean the surface of the photosensitive drum 1.

The supplying roller (i.e., a supplying member) 5 is composed of a metal shaft covered with a semiconductive silicone foam sponge layer. The supplying roller 5 is pressed against the developing roller 3 by a predetermined amount, and supplies the toner to the developing roller 3. The supplying roller 5 is connected to a supplying roller power source, and is applied with a bias voltage having the same polarity as or the opposite polarity to the toner. With such a bias voltage, the supplying roller 5 electrically charges the toner, and supplies the toner to the developing roller 3.

The developing blade (i.e., a regulating member) 6 is composed of a thin metal plate having a thickness of, for example, 0.08 mm and having substantially the same length as the developing roller 3. The developing blade 6 regulates the thickness of the toner layer on the surface of the developing roller 3 to a certain thickness. An end of the developing blade 6 in the widthwise direction is fixed to blade holders 7*a* and 7*b*, and the other end of the developing blade 6 is bent in L-shape. A bent portion of the developing blade 6 is brought into contact with the surface of the photosensitive drum 1.

The developer storage portion 8 is a chamber (i.e., a container) for transiently storing the toner supplied by the developer storage container 60 to be used in the developing device 10.

The agitator 9 is composed of a metal shaft formed integrally with a blade-shaped resin member. The agitator 9 has both ends rotatably (and slidably) supported at the developer storage container mounting portion 50. The agitator 9 is rotated by a driving force transmitted from a driving source (not shown), and supplies the toner from the developer storage container 60 to the developer storage portion 8.

Figure 3:
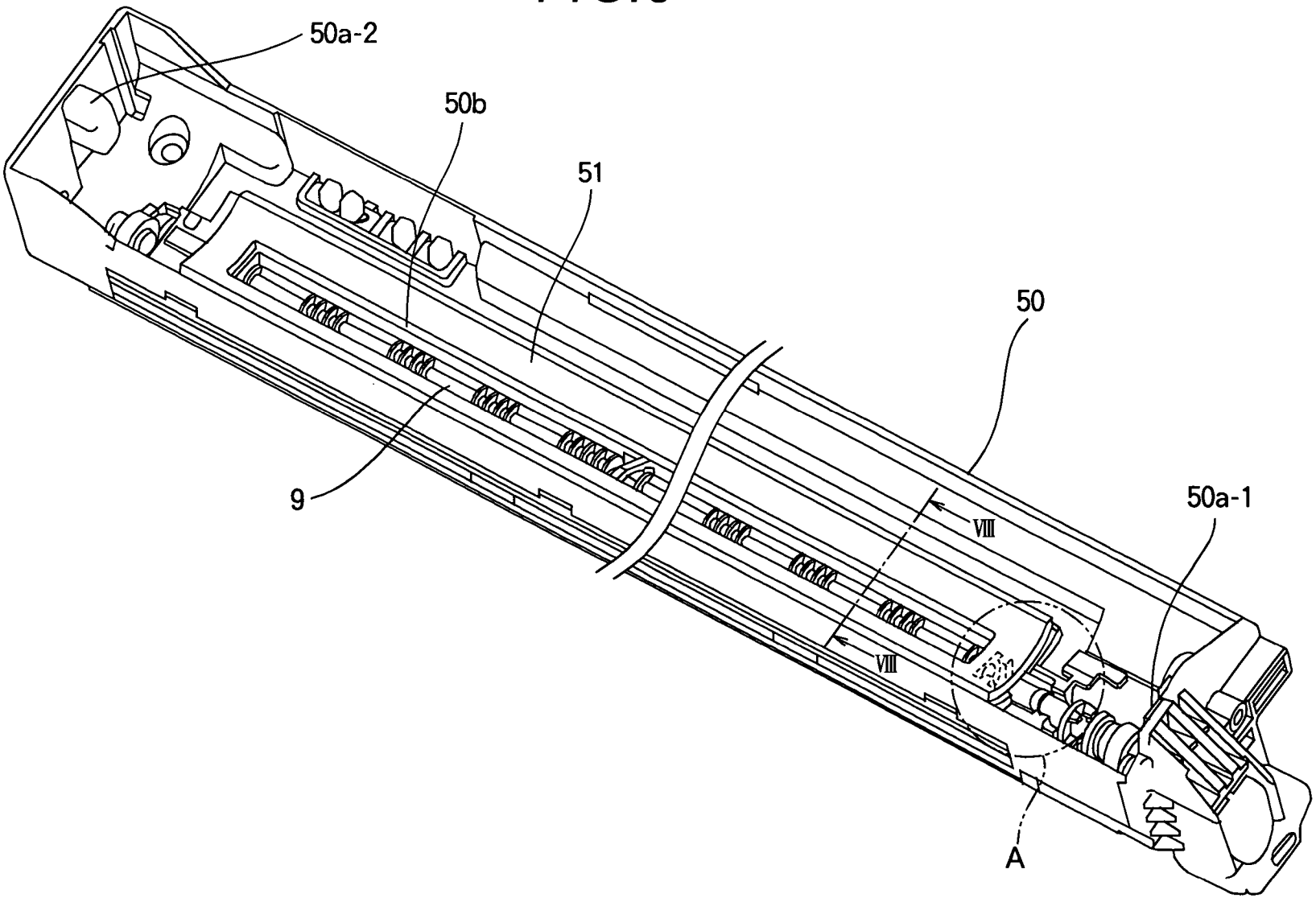
FIG. 3 is a perspective view showing a developer storage container mounting portion according to the first embodiment of the present invention.
Figure 4:
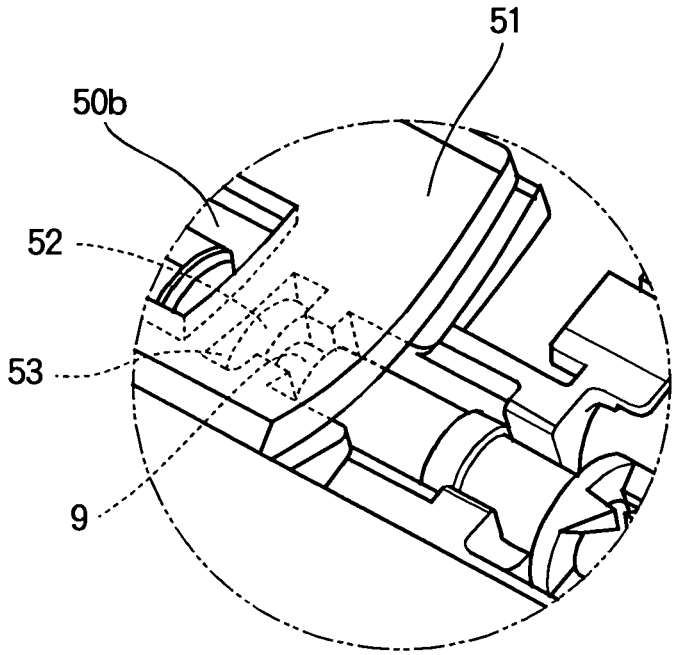
FIG. 4 is an enlarged view showing a part encircled by a circle A in FIG. 3.

Next, the developer storage container mounting portion 50 will be described with reference to FIGS. 3 and 4. FIG. 3 is a perspective view showing the developer storage container mounting portion 50. FIG. 4 is an enlarged view showing a part encircled by a circle A in FIG. 3.

As shown in FIG. 3, the developer storage container mounting portion 50 has a box shape whose top is opened. To-be-engaged portions 50*a*-1 and 50*a*-2 are formed on inner surfaces of both side walls of the developer storage container mounting portion 50. The to-be-engaged portions 50*a*-1 and 50*a*-2 are disposed corresponding to first and second engaging portions 60*a*-1 and 60*a*-2 of the developer storage container 60 (see, FIGS. 5 and 6). The first engaging portion 60*a*-1 of the developer storage container engages the to-be-engaged portion 50*a*-1 of the developer storage container mounting portion 50, and the second engaging portion 60*a*-2 of the developer storage container 60 engages the to-be-engaged portion 50*a*-2 of the developer storage container mounting portion 50, so that the developer storage container 60 is fixed to the developer storage container mounting portion 50.

A receiving opening 50*b* (i.e., a second opening) is formed at a center portion of the developer storage container mounting portion 50. The receiving opening 50*b* receives the toner supplied from the developer storage container 60. A sheet-like sealing sponge 51 (i.e., a sealing member) is adhered to a portion around the receiving opening 50*b*. The sealing sponge 51 is composed of a urethane sponge. A double-sided adhesive material 51*a* is applied to an entire surface of the sealing sponge 51 facing the portion around the receiving opening 50*b*. In this example, the sealing sponge 51 has a thickness of 4 mm and an ASKER-F hardness of 25 degrees.

The above described agitator 9 is rotatably mounted to the developer storage container mounting portion 50. As shown in FIG. 4, a seal ring 52 is provided on an end portion of the shaft of the agitator 9. The seal ring 52 is composed of a felt, and has a ring shape whose inner diameter is smaller than an outer diameter of the shaft of the agitator 9. The shaft of the agitator 9 is inserted through a center hole of the seal ring 52, and the ring 52 is fitted into a groove portion 53 formed on the developer storage container mounting portion 50. With such a structure, leakage of the toner along the shaft of the agitator 9 is prevented.

Figure 5:
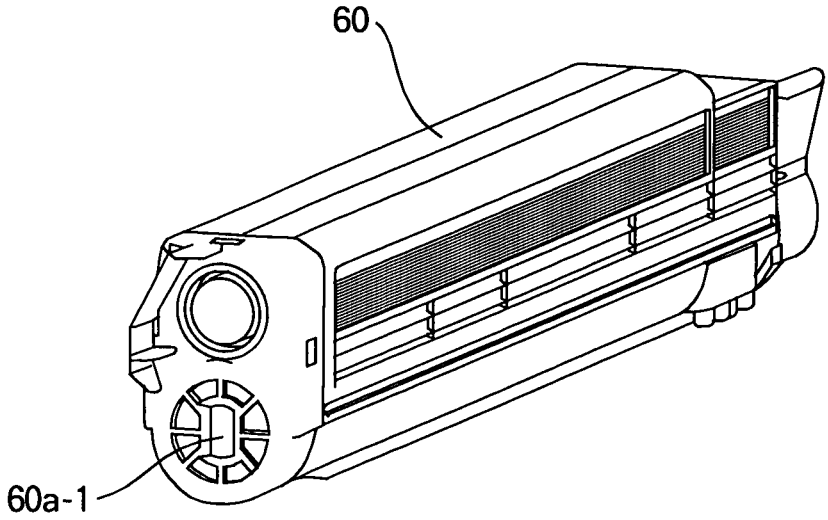
FIG. 5 is a perspective view showing an outer shape of a developer storage container according to the first embodiment of the present invention.
Figure 6:
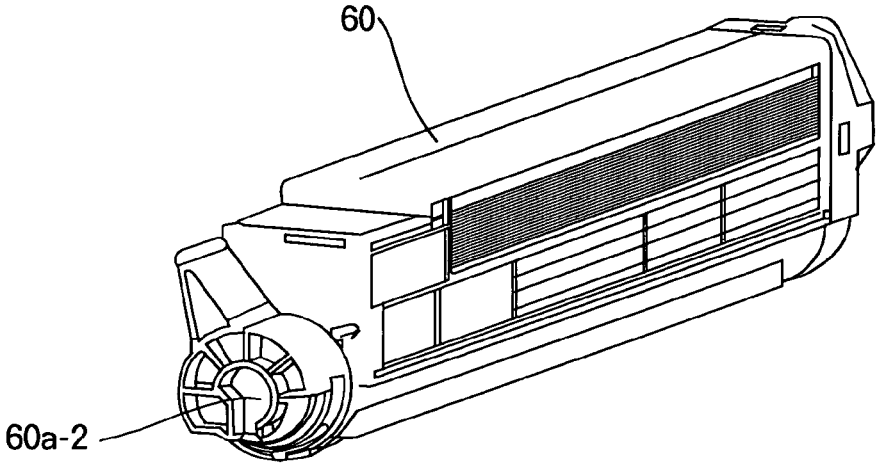
FIG. 6 is a perspective view showing the outer shape of the developer storage container according to the first embodiment of the present invention.
Figure 7:
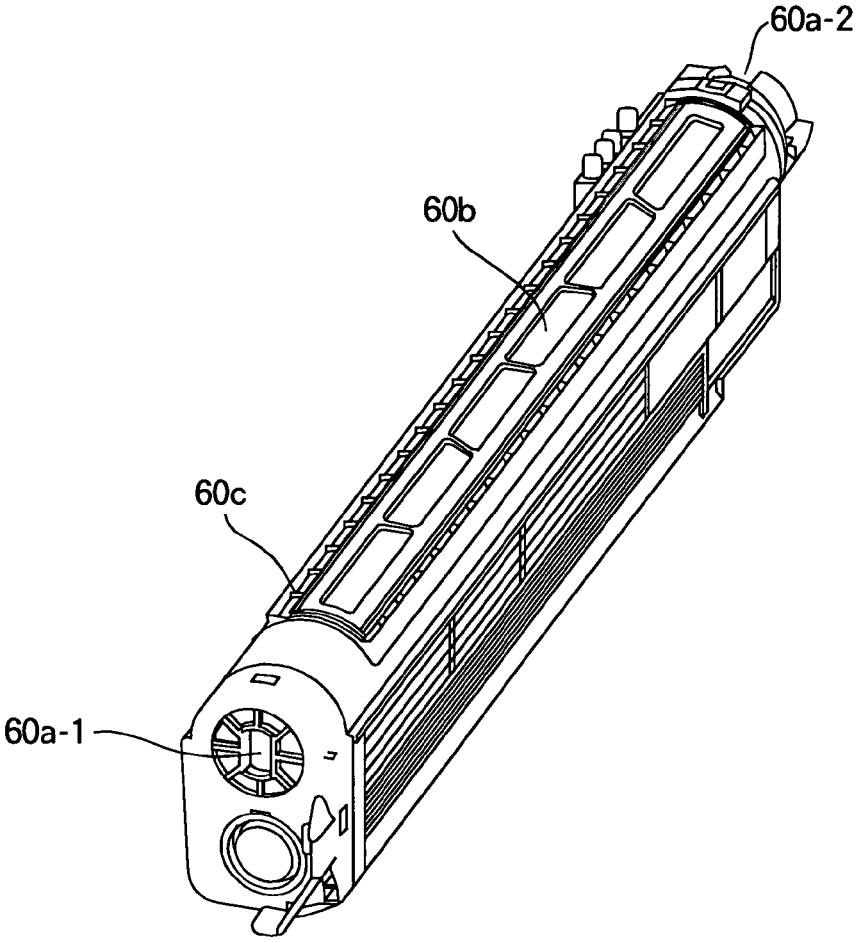
FIG. 7 is a bottom perspective view showing the outer shape of the developer storage container according to the first embodiment of the present invention.

Next, the developer storage container 60 will be described with reference to FIGS. 5, 6 and 7. FIG. 5 and are top perspective views of the developer storage container 60 as seen in different directions. FIG. 7 is a bottom perspective view of the developer storage container 60.

The developer storage container 60 (as the first storage container) has a hollow box shape in which the toner is stored. The first engaging portion 60*a*-1 and the second engaging portion 60*a*-2 are provided on both sides of the developer storage container 60, for detachably mounting the developer storage container 60 to the developer storage container mounting portion 50. The first and second engaging portions 60*a*-1 and 60*a*-2 of the developer storage container 60 respectively engage the to-be-engaged portions 50*a*-1 and 50*a*-2 of the developer storage container mounting portion 50, so that the developer storage container 60 is fixed to the developer storage container mounting portion 50.

As shown in FIG. 7, a supplying opening 60*b* (as a first opening) is formed at a center portion of the developer storage container 60, through which the toner is supplied to the developer storage portion 8 of the developing device 10. The supplying opening 60*b* is disposed on a position facing the receiving opening 50*b* of the developer storage container mounting portion 50 in a state where the first and second engaging portions 60*a*-1 and 60*a*-2 of the developer storage container 60 engage the to-be-engaged portions 50*a*-1 and 50*a*-2 of the developer storage container mounting portion 50. Further, the supplying opening 60*b* has a shape corresponding to the receiving opening 50*b*. A sealing portion 60*c* is provided around the supplying opening 60*b*. The sealing portion 60*c* (as a convex portion) has the shape of a convex rib (i.e., protrusion) whose height is, for example, 1.3 mm. The sealing portion 60*c* is provided so as to surround the supplying opening 60*b*, and protrudes outward from the surface of the developer storage container 60. Further, the sealing portion 60*c* is disposed on a position corresponding to the sealing sponge 51 around the receiving opening 50*b* of the developer storage container mounting portion 50. In this example, the sealing portion 60*c* has a width of 1 mm, but the width can be varied in accordance with specifications of the developing device 10 and the toner.

Figure 8:
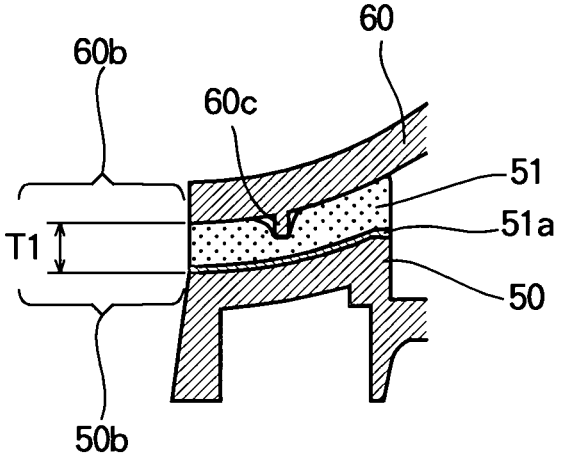
FIG. 8 is a sectional view taken along line VIII-VIII in FIG. 3.

FIG. 8 is an enlarged sectional view taken along line VIII-VIII in FIG. 3, showing a state where the developer storage container 60 is mounted to the developer storage container mounting portion 50 as shown in FIG. 2.

In a state where the developer storage container 60 is mounted to the developer storage container mounting portion 50, a gap T1 therebetween is 2.8 mm. That is, the sealing sponge 51 is compressed by an amount of 1.4 mm (in consideration of a thickness of the double-sided adhesive material 51*a*), and provides sealing performance. That is, the sealing sponge 51 is pressed between the bottom of the developer storage container 60 (with the sealing portion 60*c*) and the developer storage container mounting portion 50. Further, the sealing portion 60*c* causes a pressing force applied to the sealing sponge 51 to partially increase. Thus, the sealing portion 60*c* contributes to enhancement in sealing performance.

An image forming operation of the image forming apparatus 100 with the above described developing devices 10K, 10Y, 10M and 10C will be described.

When the image forming apparatus 100 is turned on, the image forming apparatus 100 is placed in a standby mode after performing a predetermined operation, under control of a main controlling unit (not shown). When image information is inputted via an interface, the main control unit sends instruction to a feeding control unit (not shown) to feed the recording medium 30. Upon receiving instruction, the feeding control unit starts rotating the pickup roller 41 (as the separation unit) to feed the recording medium 30 out of the recording medium storage case 31. Then, the feeding units 36 and 37 correct the skew of the recording medium 30, and feed the recording medium 30 along the recording medium feeding path to the developing devices 10.

As the feeding units 36 and 37 feed the recording medium 30 (while correcting the skew of the recording medium 30), the image forming process starts. When the recording medium 30 reaches a predetermined position along the recording medium feeding path, the photosensitive drum of the developing device 10K starts to rotate at a predetermined circumferential speed. The charging roller contacting the surface of the photosensitive drum 1 applies a voltage (supplied from the charging roller power source) to the photosensitive drum 1 so as to uniformly charge the surface of the photosensitive drum 1. The exposure head 20K facing the photosensitive drum 1 emits light to expose the surface of the photosensitive drum 1 according to inputted print data (image data). The electric potential at the exposed part attenuates, so that a latent image is formed on the surface of the photosensitive drum 1. The toner stored in the developer storage portion 8 is supplied to the developing roller 3 via the supplying roller 5. The toner on the surface of the developing roller 3 forms a uniform toner layer whose thickness is regulated by the developing blade 6.

The latent image on the surface of the photosensitive drum 1 is developed by the toner supplied by the developing roller 3, and a toner image is formed on the surface of the photosensitive drum 1. The toner image is transferred from the photosensitive drum 1 to the recording medium 30 by the transfer unit 24K.

Similarly, toner images are formed by the developing devices 10Y, 10M and 10C, and transferred to the recording medium 30 by the transfer units 24Y, 24M and 24C. As a result, the toner images of respective colors according to the print data are transferred to the recording medium 30. The residual toners remaining on the photosensitive drums 1 are removed by the cleaning blades 4, so that the photosensitive drums 1 are kept clean with no residual toner.

Then, the recording medium 30 (to which the toner images of respective colors are transferred) is fed to the fixing unit 43. In the fixing unit 43, the heat roller 43*a* and the pressure roller 43*b* fix the toner image to the recording medium 30 by applying heat and pressure thereto.

The recording medium 30 with the fixed toner image is ejected to the stacker 35 by the ejection units 38 and 39, and the printing process is completed.

When the amount of the toner in the developing device 10 becomes smaller than a predetermined amount, it is detected by a toner amount detection unit (not shown). Then, the agitator 9 is rotated by a driving force transmitted from the driving source (not shown) to supply the toner (having reached the receiving opening 50*b* via the supplying opening 60*b* of the developer storage container 60) to the developer storage portion 8. Thus, the amount of the toner in the developing device 10 is substantially kept constant.

Herewith, the toner stays in the vicinity of the supplying opening 60*b* and the receiving opening 50*b*. According to the first embodiment, in a state where the developer storage container 60 is mounted to the developing device 10, the developer storage container 60 is pressed against the sealing sponge 51. Further, the sealing portion 60*c* is pressed against the sealing sponge 51 to cause the sealing sponge 51 to be partially deformed, so that the pressing force applied to the sealing sponge 51 partially increases. With such a configuration, the leakage of the toner to the outside of the developing device 10 can be prevented. Further, even if the toner intrudes into between the sealing sponge 51 and the developer storage container 60 from the receiving opening 50*b*, the sealing portion 60*c* (i.e., the convex portion) in the form of the convex rib blocks the movement of the toner to the outside. Therefore, the toner is prevented from moving to the outside beyond the range of the sealing sponge 51. Thus, the interior of the image forming apparatus 10 can be kept clean.

In this embodiment, the sealing portion 60*c* (i.e., the convex portion) in the form of the convex rib is provided around the supplying opening 60*b* of the developer storage container 60. However, the same advantage can be obtained by providing the sealing portion around the receiving opening 50*b* of the developer storage container mounting portion 50. In this case, the sealing portion (the convex portion) is provide around the receiving opening 50*b* of the developer storage container mounting portion 50, and the sealing sponge 51 is provided around the supplying opening 60*b* of the developer storage container 60. With such a configuration, the sealing portion (the convex portion) is pressed against the sealing sponge 51 to cause the sealing sponge 51 to be partially deformed, so that the pressing force applied to the sealing sponge 51 partially increases. Thus, the leakage of the toner to the outside of the developing device 10 can be prevented. Further, even if the toner intrudes into between the sealing sponge 51 and the developer storage container 60, the sealing portion blocks the movement of the toner to the outside, with the result that the toner is prevented from moving to the outside.

In this embodiment, the sealing portion 60*c* (the convex portion) in the form of the convex rib is provided around the supplying opening 60*b*. However, it is also possible to form a plurality of sealing portions around the supplying opening 60*b* depending on effect to be achieved. For example, it is possible to provide a first sealing portion so as to surround the supplying opening 60*b*, and to provide a second sealing portion (at a predetermined distance from the first sealing portion) so as to surround the first sealing portion. An optimum distance between the first and second sealing portions can be suitably determined through experiments or the like, based on the width of the sealing portions (the convex ribs).

Furthermore, according to the first embodiment, since the sealing portion 60*c* (the convex portion) is provided around the supplying opening 60*b* of the developer storage container 60, a strength of a portion around the supplying opening 60*b* is enhanced, and therefore a deformation of the supplying opening 60*b* is suppressed. Thus, for example, when a user holds the developer storage container 60, the leakage of the toner due to the deformation of the supplying opening 60*b* is prevented.

As described above, according to the first embodiment, the sealing portion 60*c* (i.e., the convex portion) in the form of the convex rib is provided around the developer supplying opening 60*b* of the developer storage container 60. Therefore, the pressing force with which the sealing sponge 51 (the sealing member) is pressed against the developer storage container 60 increases, and the sealing portion 60*c* in the form of the convex rib blocks the movement of the toner to the outside. Thus, the sealing performance between the sealing sponge 51 and the developer storage container 60 is enhanced.

Second Embodiment

Next, the second embodiment of the present invention will be described. In the second embodiment, structures of an image forming apparatus, a developing device, a developer storage container and a developer storage container mounting portion are substantially the same as those of the first embodiment. Further, in the second embodiment, an image forming operation is substantially the same as that of the first embodiment. Therefore, components that are the same as those of the first embodiment are assigned the same reference numerals, and explanations thereof will be omitted.

Figure 9:
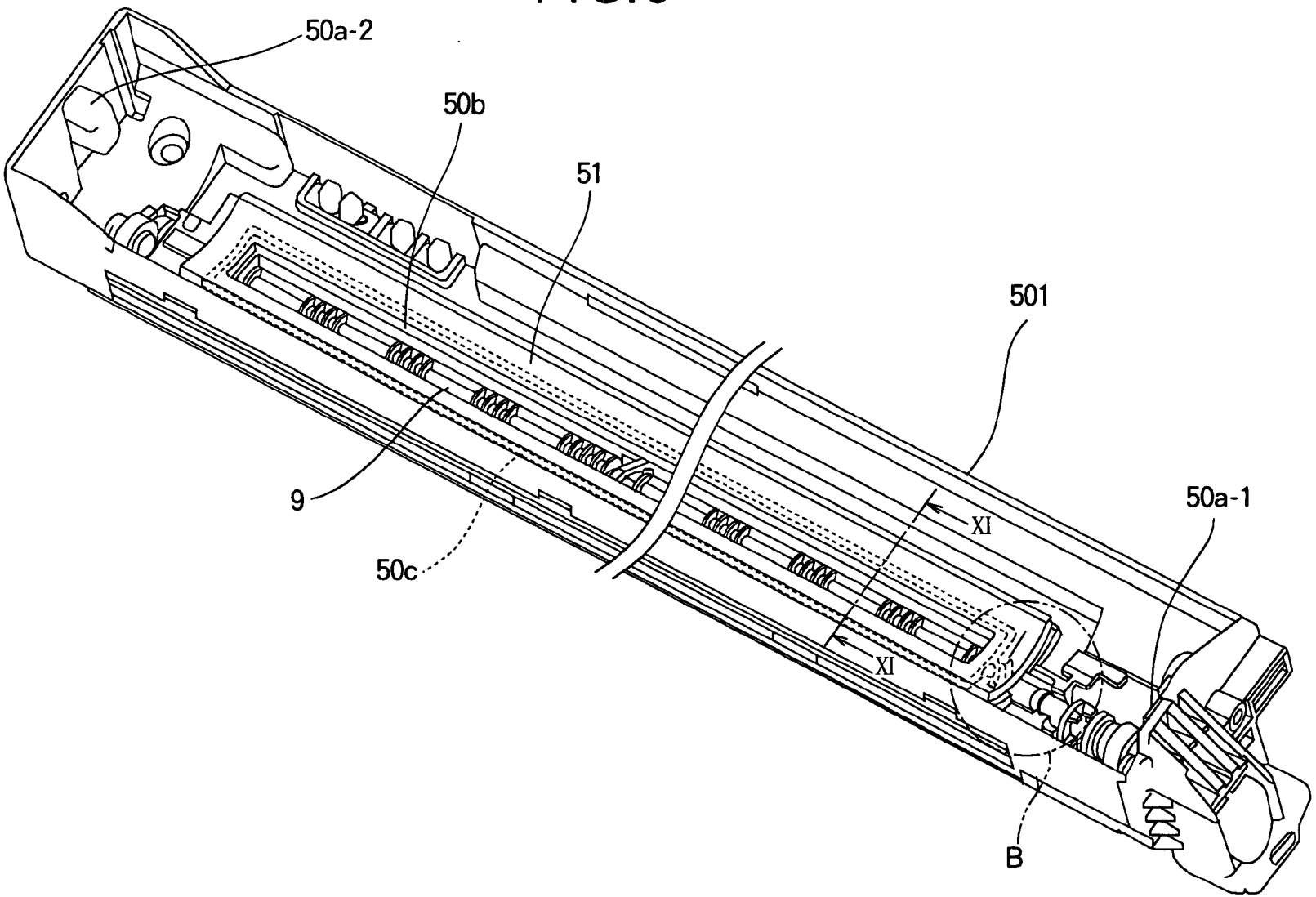
FIG. 9 is a perspective view showing a developer storage container mounting portion according to the second embodiment of the present invention.
Figure 10:
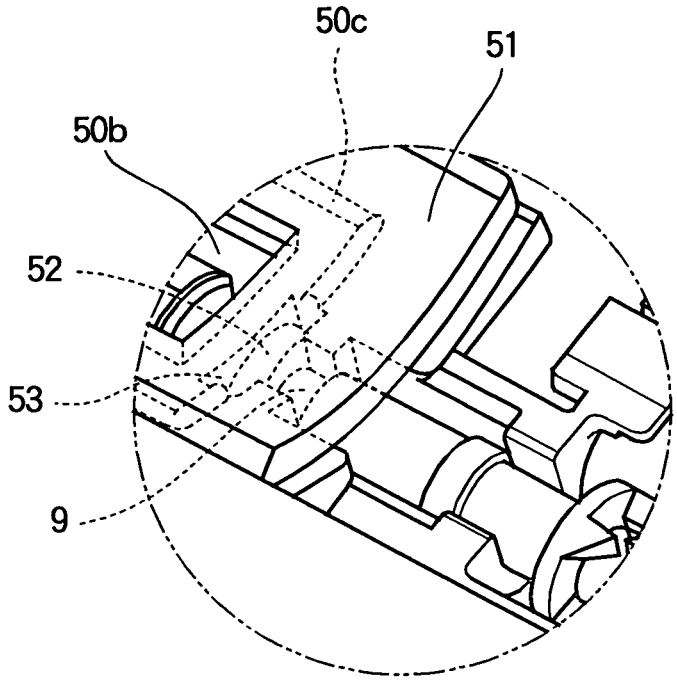
FIG. 10 is an enlarged view showing a part encircled by a circle B in FIG. 9.

FIG. 9 is a perspective view showing a developer storage container mounting portion 501 according to the second embodiment. FIG. 10 is an enlarged view showing a part encircled by a circle B in FIG. 9.

As shown in FIG. 9, the developer storage container mounting portion 501 has a box shape whose top is opened. To-be-engaged portions 50*a*-1 and 50*a*-2 are formed on inner surfaces of both side walls of the developer storage container mounting portion 501. The to-be-engaged portions 50*a*-1 and 50*a*-2 are disposed corresponding to first and second engaging portions 60*a*-1 and 60*a*-2 of the developer storage container 60 (see, FIGS. 5 and 6). The first engaging portion 60*a*-1 and the second engaging portion 60*a*-2 of the developer storage container 60 respectively engage the to-be-engaged portion 50*a*-1 and the to-be-engaged portion 50*a*-2 of the developer storage container mounting portion 501, so that the developer storage container 60 is fixed to the developer storage container mounting portion 501.

A receiving opening 50*b* (i.e., a second opening) is formed at a center portion of the developer storage container mounting portion 501. The receiving opening 50*b* receives the toner supplied from the developer storage container 60. A sealing portion 50*c* (as a pressing portion) is provided around the receiving opening 50*b*. The sealing portion 50*c* has a shape of a convex rib whose height is, for example, 1 mm. The sealing portion 50*c* is provided so as to face the sealing portion 60*c* of the developer storage container 60 (described in the first embodiment) via the sealing sponge 51.

Further, a sheet-like sealing sponge 51 (i.e., a sealing member) is adhered to a portion around the receiving opening 50*b*. The sealing sponge 51 is composed of a urethane sponge. A double-sided adhesive material 51*a* is applied to an entire surface of the sealing sponge 51 facing the portion around the receiving opening 50*b*. In this example, the sealing sponge 51 has a thickness of 4 mm and an ASKER-F hardness of 25 degrees.

The agitator 9 is rotatably mounted to the developer storage container mounting portion 501. As shown in FIG. 10, a seal ring 52 is provided on an end portion of the shaft of the agitator 9. The seal ring 52 is composed of a felt, and has a ring shape whose inner diameter is smaller than an outer diameter of the shaft of the agitator 9. The shaft of the agitator 9 is inserted through a center hole of the seal ring 52, and the ring 52 is fitted into a groove portion 53 of the developer storage container mounting portion 501, so that the leakage of the toner along the shaft of the agitator 9 is prevented.

Figure 11:
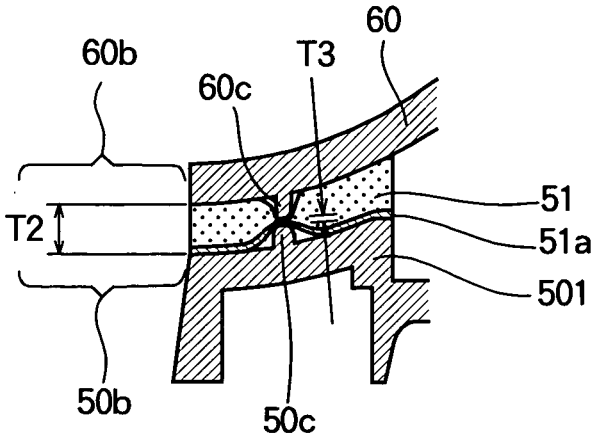
FIG. 11 is a sectional view taken along line XI-XI in FIG. 9.

FIG. 11 is an enlarged sectional view taken along line XI-XI in FIG. 9, showing a state where the developer storage container 60 is mounted to the developer storage container mounting portion 501 as shown in FIG. 2.

Figure 12:
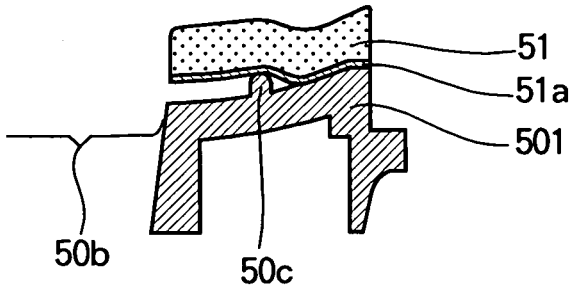
FIG. 12 is a sectional view for illustrating a peeling of a sealing sponge.

In a state where the developer storage container 60 is mounted to the developer storage container mounting portion 501, a gap T2 therebetween is 2.8 mm. That is, the sealing sponge 51 is compressed by an amount of 1.4 mm, and provides sealing performance. Further, a gap T3 between the sealing portion 60*c* and the sealing portion 50*c* is 0.5 mm. Therefore, a part of the sealing sponge 51 between the sealing portion 60*c* and the sealing portion 50*c* is applied with a higher pressing force than in the first embodiment. Therefore, the second embodiment provides higher sealing performance than in the first embodiment. Moreover, for example, even if the sealing sponge 51 is peeled off and the toner intrudes into between the adhesion surfaces (i.e., between the sealing sponge 51 and the developer storage container mounting portion 501) as shown in FIG. 12, the sealing portion 50*c* blocks the movement of the toner.

As described above, the image forming operation in the second embodiment is the same as that in the first embodiment.

When the amount of the toner in the developing device 10 becomes smaller than a predetermined amount, it is detected by the toner amount detection unit (not shown). Then, the agitator 9 is rotated by the driving force transmitted from the driving source (not shown) to supply the toner (having reached the receiving opening 50*b* via the supplying opening 60*b* of the developer storage container 60) to the developer storage portion 8. Thus, the amount of the toner in the developing device 10 is substantially kept constant.

Herewith, the toner stays in the vicinity of the supplying opening 60*b* and the receiving opening 50*b*. According to the second embodiment, in a state where the developer storage container 60 is mounted to the developing device 10, the developer storage container 60 is pressed against the sealing sponge 51. Further, the sealing sponge 51 is sandwiched and pressed by the sealing portion 60*c* and the sealing portion 50*c* provided facing each other, so that the pressing force applied to the sealing sponge 51 increases. With such a configuration, the leakage of the toner to the outside can be prevented. Further, even if the sealing sponge 51 is peeled off and the toner intrudes into between the adhesion surfaces, the sealing portion 50*c* (provided on the developer storage container mounting portion 501) blocks the movement of the toner. Therefore, the toner is prevented from moving to the outside beyond the range of the sealing sponge 51, with the result that the interior of the image forming apparatus 10 can be kept clean.

As described above, according to the second embodiment, the sealing portion 60*c* (i.e., the convex portion) in the form of the convex rib is provided around the developer supplying opening 60*b* of the developer storage container 60, and the sealing portion 50*c* (i.e., the pressing portion) in the form of the convex rib is formed around the developer receiving opening 50*b* so as to face the sealing portion 60*c*. Therefore, the pressing force applied to the sealing sponge 51 increases, and the sealing performance between the sealing sponge 51 and the developer storage container 60 is enhanced. Further, even if the peeling of the sealing sponge 51 occurs, the sealing portion 50*c* in the form of the convex rib blocks the movement of the toner to the outside. Thus, the sealing performance between the sealing sponge 51 and the developer storage container mounting portion 501 is also enhanced.

Third Embodiment

Next, the third embodiment of the present invention will be described. In the third embodiment, structures of an image forming apparatus, a developing device, a developer storage container and a developer storage container mounting portion are substantially the same as those of the second embodiment. Further, in the third embodiment, an image forming operation is substantially the same as that of the second embodiment. Therefore, components that are the same as those of the second embodiment are assigned the same reference numerals, and explanations thereof will be omitted.

Figure 13:
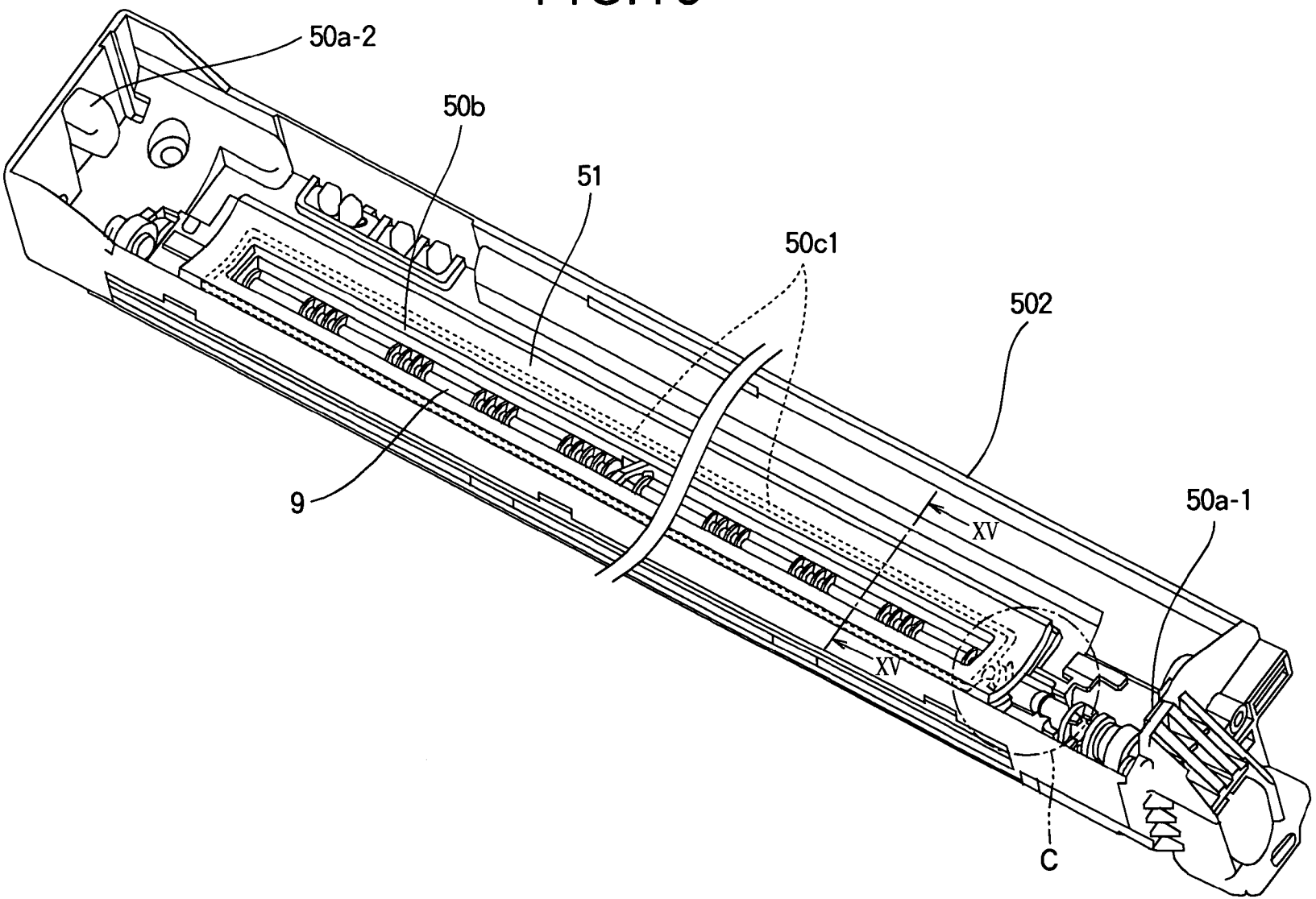
FIG. 13 is a perspective view showing a developer storage container mounting portion according to the third embodiment of the present invention.
Figure 14:
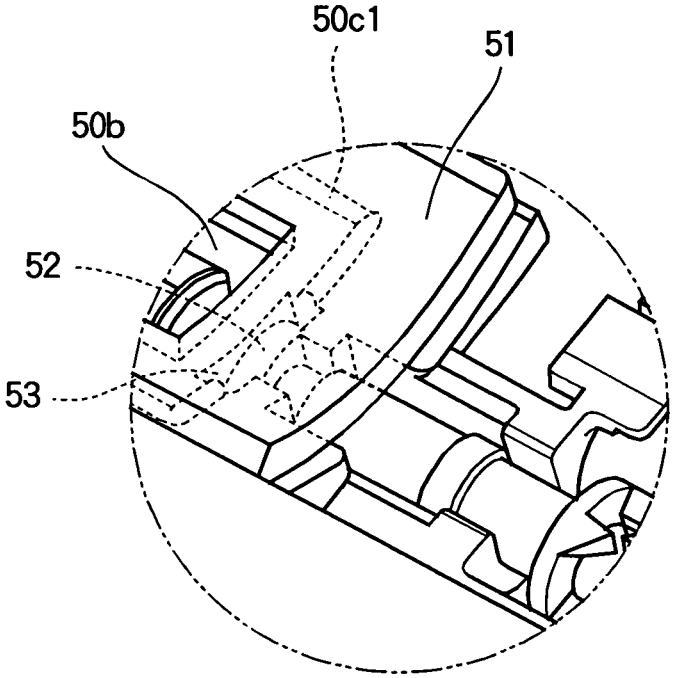
FIG. 14 is an enlarged view showing a part encircled by a circle C in FIG. 13.

FIG. 13 is a perspective view showing a developer storage container mounting portion 502 according to the third embodiment. FIG. 14 is an enlarged view showing a part encircled by a circle C in FIG. 13.

As shown in FIG. 13, the developer storage container mounting portion 502 has a box shape whose top is opened. To-be-engaged portions 50*a*-1 and 50*a*-2 are formed on inner surfaces of both side walls of the developer storage container mounting portion 502. The to-be-engaged portions 50*a*-1 and 50*a*-2 are disposed corresponding to first and second engaging portions 60*a*-1 and 60*a*-2 of the developer storage container 60 (see, FIGS. 5 and 6). The first engaging portion 60*a*-1 and the second engaging portion 60*a*-2 of the developer storage container 60 respectively engage the to-be-engaged portion 50*a*-1 and the to-be-engaged portion 50*a*-2 of the developer storage container mounting portion 502, so that the developer storage container 60 is fixed to the developer storage container mounting portion 502.

A receiving opening 50*b* (i.e., a second opening) is formed at a center portion of the developer storage container mounting portion 502. The receiving opening 50*b* receives the toner supplied from the developer storage container 60. A sealing portion 50*c*1 (as a pressing portion) is provided around the receiving opening 50*b*. The sealing portion 50*c*1 has a shape of a convex rib whose height is, for example, 1 mm. The sealing portion 50*c*1 is disposed on an inner side (i.e., the receiving opening 50*b* side) with respect to a portion facing the sealing portion 60*c* of the developer storage container 60 via the sealing sponge 51.

Further, a sheet-like sealing sponge 51 (i.e., a sheet member) is adhered to a portion around the receiving opening 50*b*. The sealing sponge 51 is composed of a urethane sponge. A double-sided adhesive material 51*a* is applied to an entire surface of the sealing sponge 51 facing the portion around the receiving opening 50*b*. In this example, the sealing sponge 51 has a thickness of 4 mm and an ASKER-F hardness of 25 degrees.

The above described agitator 9 is rotatably mounted to the developer storage container mounting portion 502. As shown in FIG. 14, a seal ring 52 is provided on an end portion of the shaft of the agitator 9. The seal ring 52 is composed of a felt, and has a ring shape whose inner diameter is smaller than an outer diameter of the shaft of the agitator 9. The shaft of the agitator 9 is inserted through a center hole of the seal ring 52, and the ring 52 is fitted into a groove portion 53 of the developer storage container mounting portion 502, so that the leakage of the toner along the shaft of the agitator 9 is prevented.

Figure 15:
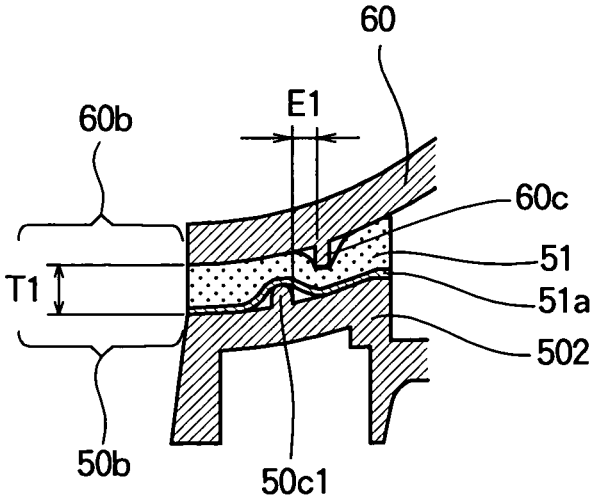
FIG. 15 is a sectional view taken along line XV-XV in FIG. 13.

FIG. 15 is an enlarged sectional view taken along line XV-XV in FIG. 13, showing a state where the developer storage container 60 is mounted to the developer storage container mounting portion 502 as shown in FIG. 2.

In a state where the developer storage container 60 is mounted to the developer storage container mounting portion 502, a gap T2 therebetween is 2.8 mm. That is, the sealing sponge 51 is compressed by an amount of 1.4 mm, and provides sealing performance. The sealing portion 60*c* and the sealing portion 50*c*1 are distanced from each other in the horizontal direction by a distance E1 of 1.2 mm. Therefore, a gap between the sealing portion 60*c* and the sealing portion 50*c*1 is wider than in the second embodiment (see FIG. 11). That is, the pressing force applied to the sealing sponge 51 is relatively lower than in the second embodiment. With such a configuration, according to the third embodiment, even if the toner intrudes into between the sealing sponge 51 and the developer storage container mounting portion 502 from the receiving opening 50*b*, the sealing portion 50*c*1 blocks the movement of the toner. Moreover, a part of the sealing sponge 51 between the sealing portion 60*c* and the sealing portion 50*c*1 is deformed in a Z-shape, and therefore a deformation amount of the sealing sponge 51 is relatively small. Thus, the lifetime of the sealing sponge 51 can be lengthened.

As described above, the image forming operation in the third embodiment is the same as that in the second embodiment.

When the amount of the toner in the developing device 10 becomes smaller than a predetermined amount, it is detected by the toner amount detection unit (not shown). Then, the agitator 9 is rotated by the driving force transmitted from the driving source (not shown) to supply the toner (having reached the receiving opening 50*b* via the supplying opening 60*b* of the developer storage container 60) to the developer storage portion 8. Thus, the amount of the toner in the developing device 10 is substantially kept constant.

Herewith, the toner stays in the vicinity of the supplying opening 60*b* and the receiving opening 50*b*. According to the third embodiment, in a state where the developer storage container 60 is mounted to the developing device 10, the developer storage container 60 is pressed against the sealing sponge 51. Further, since the sealing sponge 51 is sandwiched and pressed by the sealing portion 60*c* and the sealing portion 50*c*1 (disposed on the receiving opening 50*b* side with respect to the portion facing the sealing portion 60*c*), the pressing force applied to the sealing sponge 51 is relatively light. Therefore, a load on the sealing sponge 51 is relatively low, and degradation of the sealing sponge 51 is prevented. Thus, for a prolonged time, the toner is prevented from moving to the outside beyond the range of the sealing sponge 51, and the interior of the image forming apparatus 10 can be kept clean.

The sealing portion 50*c*1 on the developer storage container mounting portion 502 provides the same advantage as the sealing portion 50*c* described in the second embodiment. Further, as the sealing sponge 51 is deformed in substantially Z-shape due to the provision of the sealing portion 60*c* of the developer storage container 60, the deformed part of the sealing sponge 15 is pressed against the developer storage container mounting portion 502 by the sealing portion 60*c*. As was described in the second embodiment, even if the toner leakage occurs at the adhesion surfaces, the sealing portion 50*c*1 formed on the developer storage container mounting portion 502 blocks the movement of the toner. Thus, the leakage of the toner can be prevented, and the lifetime of the sealing sponge 51 can be lengthened.

In the above description, the sealing portion 60*c* and the sealing portion 50*c*1 have convex shapes whose apexes (i.e., portions contacting the sealing sponge 51) do not cross each other. However, it is also possible that the sealing portion 60*c* and the sealing portion 50*c*1 have convex shapes whose apexes cross each other so as to enhance sealing performance, in consideration of a manner in which toner moves, a durability of the sealing sponge 51, and the like.

Further, it is also possible that the sealing portion 50*c*1 of the developer storage container mounting portion 502 is disposed on the outer side with respect to the sealing portion 60*c* of the developer storage container 60. In this case, the sealing portion 60*c* of the developer storage container 60 effectively bocks the movement of the toner through between non-adhesion surfaces (i.e., between the sealing sponge 51 and the developer storage container 60) where the toner may easily move as compared with between the adhesion surfaces (i.e., between the sealing sponge 51 and the developer storage container mounting portion 502).

Additionally, it is also possible to increase the distance E1 between the sealing portion 50*c*1 and the sealing portion 60*c*, so as to increase a contact surface area between the sealing sponge 51 and the developer storage container 60 in the area of the distance E1. In this case, the amount of the toner reaching the sealing portion 60*c* of the developer storage container 60 (which has been reduced by the sealing portion 50*c*1) can be further reduced. Further, as the distance E1 is increased, the deformation amount of the sealing sponge 51 in the Z-shape is reduced, and therefore the lifetime of the sealing sponge 51 can be further lengthened.

Alternatively, it is also possible to reduce the distance E1 between the sealing portion 51*c* and the sealing portion 60*c* (for example, to be smaller than the thickness T1 of the sealing sponge 51). In this case, the sealing sponge 51 tightly contacts the sealing portion 51*c* and the sealing portion 61*c* in the area of the distance E1, and therefore the movement of the toner is effectively prevented. The distance E1 between the sealing portion 51*c* and the sealing portion 60*c* can be suitably determined based on characteristics of the toner, operating conditions of the image forming apparatus 100, and the like.

As described above, according to the third embodiment, the sealing portion 60*c* (i.e., the convex portion) in the form of the convex rib is formed around the developer supplying opening 60*b* of the developer storage container 60, and the sealing portion 50*c*1 (i.e., the pressing portion) in the form of the convex rib is formed around the developer receiving opening 50*b* on the inner side (i.e., the receiving opening 50*b* side) with respect to the portion facing the sealing portion 60*c*. Therefore, the lifetime of the sealing sponge 51 can be lengthened, in addition to the advantages described in the first and second embodiments.

Fourth Embodiment

Next, the fourth embodiment of the present invention will be described. In the fourth embodiment, structures of an image forming apparatus, a developing device, a developer storage container and a developer storage container mounting portion are substantially the same as those of the first embodiment. Further, in the fourth embodiment, an image forming operation is substantially the same as that of the first embodiment. Therefore, components that are the same as those of the first embodiment are assigned the same reference numerals, and explanations thereof will be omitted.

Figure 16:
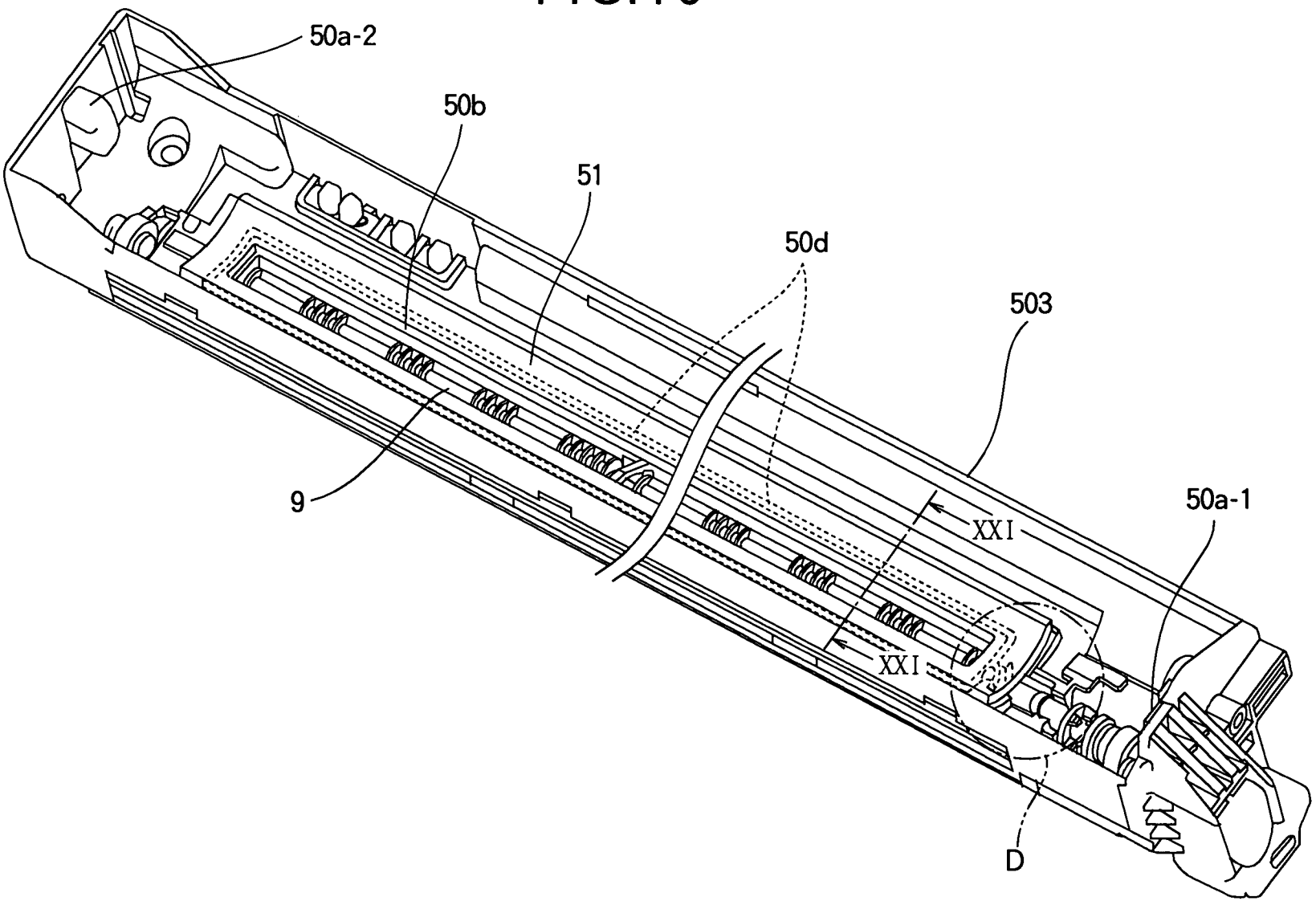
FIG. 16 is a perspective view showing a developer storage container mounting portion according to the fourth embodiment of the present invention.
Figure 17:
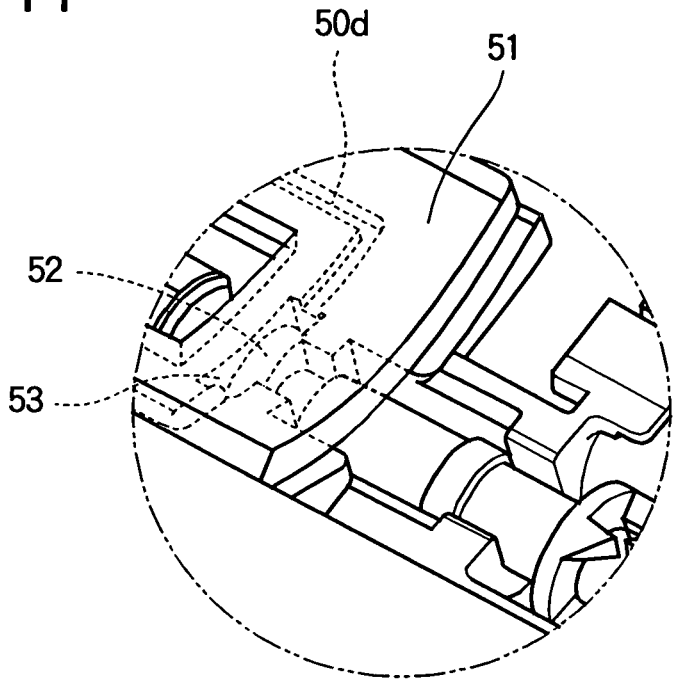
FIG. 17 is an enlarged view showing a part encircled by a circle D in FIG. 16.

FIG. 16 is a perspective view showing a developer storage container mounting portion 503 according to the fourth embodiment. FIG. 17 is an enlarged view showing a part encircled by a circle D in FIG. 16.

As shown in FIG. 16, the developer storage container mounting portion 503 has a box shape whose top is opened. To-be-engaged portions 50*a*-1 and 50*a*-2 are formed on inner surfaces of both side walls of the developer storage container mounting portion 503. The to-be-engaged portions 50*a*-1 and 50*a*-2 are disposed corresponding to first and second engaging portions 60*a*-1 and 60*a*-2 of a developer storage container 601 (see, FIG. 12). The first engaging portion 60*a*-1 and the second engaging portion 60*a*-2 of the developer storage container 601 respectively engage the to-be-engaged portion 50*a*-1 and the to-be-engaged portion 50*a*-2 of the developer storage container mounting portion 503, so that the developer storage container 601 is fixed to the developer storage container mounting portion 503.

A receiving opening 50*b* (i.e., a second opening) is formed at a center portion of the developer storage container mounting portion 503. The receiving opening 50*b* receives the toner supplied from the developer storage container 601. Further, a groove 50*d* (i.e., a pressing portion) is formed around the receiving opening 50*b*. The groove 50*d* has a depth of, for example, 0.5 mm. A sheet-like sealing sponge 51 (i.e., a sealing member) is adhered to a portion around the receiving opening 50*b*. The sealing sponge 51 is composed of a urethane sponge. A double-sided adhesive material 51*a* is applied to an entire surface of the sealing sponge 51 facing the portion around the receiving opening 50*b*. In this example, the sealing sponge 51 has a thickness of 4 mm and an ASKER-F hardness of 25 degrees.

Figure 18:
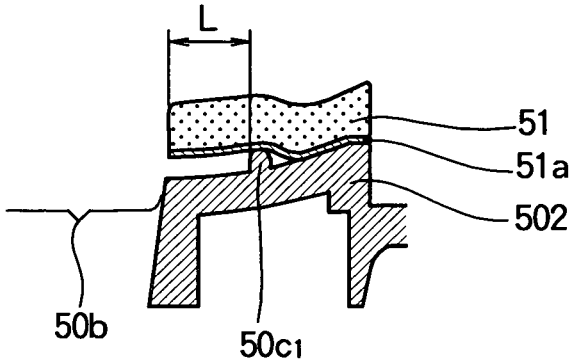
FIG. 18 is a sectional view for illustrating a state where the sealing sponge is peeled off from the developer storage container mounting portion.
Figure 19:
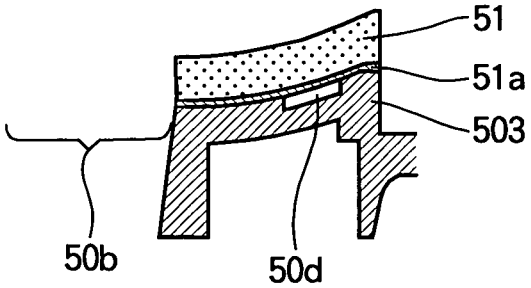
FIG. 19 is a sectional view for illustrating a state where the sealing sponge is adhered to the developer storage container mounting portion.

As shown in FIG. 18, in the above described third embodiment, the sealing portion 50*c*1 in the form of the convex rib having the height of 1 mm is formed on the surface of the developer storage container mounting portion 502 to which the sealing sponge 51 is adhered. Therefore, if the distance L between the receiving opening 50*b* and a root of the sealing portion 50*c*1 is short, the contact area between the sealing sponge 51 and the developer storage container mounting portion 502 may become small due to elasticity of the sealing sponge 51. In such a case, the sealing sponge 51 may peel off from the developer storage container mounting portion 502 as shown in FIG. 18. However, according to the fourth embodiment, no convex portion is formed on the surface of the developer storage container mounting portion 503 to which the sealing sponge 51 is adhered, as shown in FIG. 19. Therefore, the sealing sponge 51 is surely adhered to the developer storage container mounting portion 503.

The above described agitator 9 is rotatably mounted to the developer storage container mounting portion 503. As shown in FIG. 17, a seal ring 52 is provided on an end portion of the shaft of the agitator 9. The seal ring 52 is composed of a felt, and has a ring shape whose inner diameter is smaller than an outer diameter of the shaft of the agitator 9. The shaft of the agitator 9 is inserted through a center hole of the seal ring 52, and the ring 52 is fitted into a groove portion 53 of the developer storage container mounting portion 503, so that the leakage of the toner along the shaft of the agitator 9 is prevented.

Figure 20:
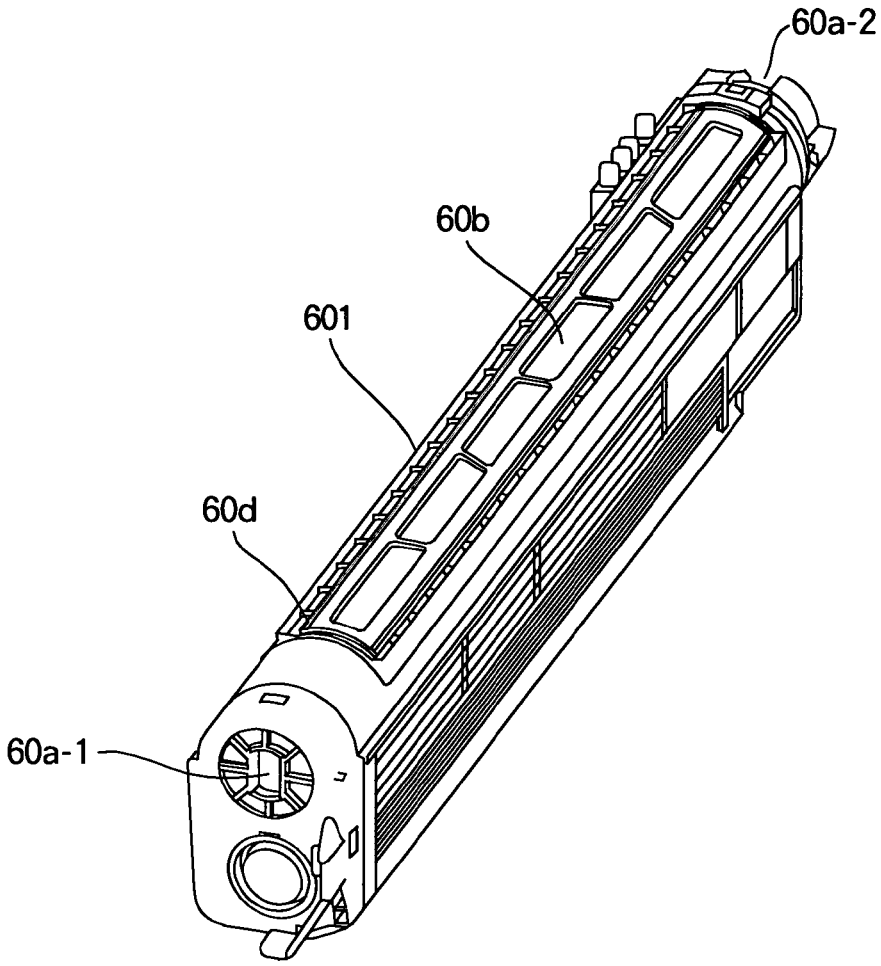
FIG. 20 is a perspective view showing the developer storage container according to the fourth embodiment.

Further, as shown in FIG. 20, a supplying opening 60*b* (as the first opening) is formed at a center portion of the bottom of the developer storage container 601. The supplying opening 60*b* is disposed on a position facing the receiving opening 50*b* when the first and second engaging portions 60*a*-1 and 60*a*-2 of the developer storage container 60 engage the respective to-be-engaged portions 50*a*-1 and 50*a*-2 of the developer storage container mounting portion 50. Further, a sealing portion 60*d* is provided around the supplying opening 60*b*. The sealing portion 60*d* has a shape of a convex rib (i.e., a protrusion) whose height is, for example, 1.9 mm. The sealing portion 60*d* is provided so as to surround the supplying opening 60*b*, and extends outward from the surface of the developer storage container 60. Further, the sealing portion 60*d* is disposed at a position corresponding to the sealing sponge 51 around the receiving opening 50*b* of the developer storage container mounting portion 503. In this example, the sealing portion 60*d* has a width of 1 mm, but the width can be suitably varied in accordance with the developing device 10 and the toner.

In a state where the developer storage container 601 is mounted to the developer storage container mounting portion 503, a gap T2 therebetween is 2.8 mm. In this state, the sealing sponge 51 is compressed by an amount of 1.4 mm, and provides sealing performance. Further, the sealing sponge 51 is pressed by the sealing portion 60*d* against the groove 50*d*, and is deformed in a U-shape. Distances E2 and E3 from the sealing portion 60*d* to either end (i.e., inner wall) of the groove 50*d* are both 1.2 mm. The sealing performance is enhanced particularly where the sealing sponge 51 is pressed by the sealing portion 60*d* against the groove 50*d*.

The image forming operation in the fourth embodiment is the same as in the first embodiment. When the amount of the toner in the developing device 10 becomes smaller than a predetermined amount, it is detected by the toner amount detection unit (not shown). Then, the agitator 9 is rotated by a driving force transmitted from the driving source (not shown) to supply the toner (having reached the receiving opening 50*b* via the supplying opening 60*b* of the developer storage container 601) to the developer storage portion 8. Thus, the amount of the toner in the developing device 10 is substantially kept constant.

Herewith, the toner stays in the vicinity of the supplying opening 60*b* and the receiving opening 50*b*. According to the fourth embodiment, in a state where the developer storage container 601 is mounted to the developing device 10, the developer storage container 601 is pressed against the sealing sponge 51. Further, since no convex portion is provided on the surface (i.e. the adhesion surface) of the developer storage container mounting portion 503 to which the sealing sponge 51 is adhered, the sealing sponge 51 is surely adhered to the surface of the developer storage container mounting portion 503. Therefore, the toner is prevented from moving to the outside beyond the range of the sealing sponge 51, and the interior of the image forming apparatus 10 can be kept clean.

Further, since no convex portion is formed on the adhesion surface to which the sealing sponge 51 is adhered, an operation to adhere the sealing sponge 51 to the developer storage container mounting portion 503 can be easily performed. Thus, the sealing sponge 51 is surely adhered to the surface of the developer storage container mounting portion 503, with the result that the movement of the toner along the adhesion surface is prevented.

Figure 21:
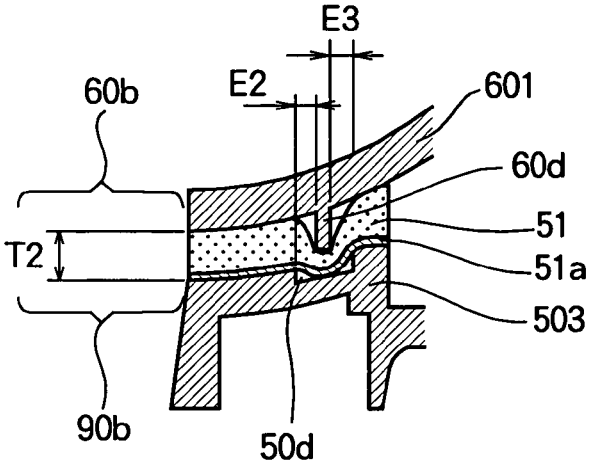
FIG. 21 is a sectional view taken along line XXI-XXI in FIG. 16.

In this regard, since the groove 50*d* (i.e., concave) is formed on the adhesion surface to which the sealing sponge 51 is adhered, there is a possibility that the sealing sponge 51 may not be adhered to corners of the groove 50*d*. However, the sealing portion 60*d* (i.e., the convex portion) pushes the sealing sponge 51 against the groove 50*d*. Therefore, even if the toner moves into the area of the distance E2 (FIG. 21), the movement of the toner is blocked by the sealing sponge 51 pressed by the sealing portion 60*d*. Further, even if the toner moves beyond the sealing portion 60*d* into the area of the distance E3, the movement of the toner is blocked by the inner wall of the groove 50*d* on the farther side from the receiving opening 50*b*.

In this fourth embodiment, the sealing portion 60*d* (i.e., the convex portion) has a larger protruding amount than in other embodiments, since the groove 50*d* is formed on the developer storage container mounting portion 503. As a height of the sealing portion 60*d* increases, the sealing portion 60*d* more effectively blocks the movement of the toner intruding into between non-adhesion surfaces (i.e., between the sealing sponge 51 and the developer storage container 601). Therefore, the movement of the toner between the non-adhesion surfaces can be blocked more effectively, as compared with other embodiments.

As described above, according to the fourth embodiment, the sealing portion 60*d* (i.e., the convex pinching portion) in the form of the convex rib is formed around the supplying opening 60*b* of the developer storage container 60, and the groove portion 50*d* (i.e., the pressing portion) in the form of the concave is formed around the receiving opening 50*b* so as to face the sealing portion 60*d*. Therefore, the leakage of the toner is effectively prevented, and the operation to adhere the sealing sponge 51 to the developer storage container mounting portion 503 is facilitated.

In the first through fourth embodiments, the present invention is embodied in the developing devices for storing the developer as powder. However, the present invention is applicable to a container for storing powder or liquid.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a first storage container configured to store a developer therein, said first storage container having a first opening through which said developer is ejected and a first convex portion provided around said first opening; and a second storage container having a second opening provided at a position corresponding to said first opening, a second convex portion provided around said second opening and a sealing member provided around said second opening;

wherein said first convex portion is provided on a surface of said first storage container facing said second storage container so that said first convex portion is pressed against said sealing member; and wherein said second convex portion is provided on a surface of said second storage container facing said first storage container.

2. The developing device according to claim 1, wherein said first convex portion is provided so as to entirely surround said first opening.

3. The developing device according to claim 2, wherein said second convex portion is provided so as to entirely surround said second opening.

4. The developing device according to claim 1, wherein said first convex portion and said second convex portion sandwich said sealing member therebetween.

5. The developing device according to claim 1, wherein said first convex portion and said second convex portion are disposed so as to face each other.

6. The developing device according to claim 1, wherein said second convex portion is shifted with respect to said first convex portion toward said second opening side or opposite side.

7. The developing device according to claim 1, wherein a gap between said first convex portion and said second convex portion is less than a thickness of said sealing member in a state where said sealing member is not compressed.

8. The developing device according to claim 1, wherein said sealing member has an adhesion portion facing said first storage container or said second storage container.

9. The developing device according to claim 1, wherein said sealing member is composed of a urethane sponge which can be compressed by being pressed by said first storage container.

10. An image forming apparatus comprising said developing device according to claim 1.

* * * * *